US005309831A

United States Patent [19]

Fuqua et al.

[11] Patent Number: 5,309,831

[45] Date of Patent: May 10, 1994

[54] ROTATABLE, MULTI-COLOR SCREEN PRINTING APPARATUS

[75] Inventors: Rick L. Fuqua, Chicago; Salvatore Prainito, Highland Park; David Pelko, Bridgeview; Alex Iaccino, Mount Prospect, all of Ill.

[73] Assignee: American M & M, Oshkosh, Wis.

[21] Appl. No.: 958,278

[22] Filed: Oct. 8, 1992

Related U.S. Application Data

[62] Division of Ser. No. 592,037, Oct. 3, 1990, Pat. No. 5,154,119.

[51] Int. Cl.[5] ..... B05C 17/06

[52] U.S. Cl. ..... 101/126; 74/817

[58] Field of Search ..... 101/115, 123, 124, 126; 74/25, 27, 38, 126, 816, 817, 827; 409/221

[56] References Cited

U.S. PATENT DOCUMENTS

| | | | |
|---|---|---|---|
| 3,170,333 | 2/1965 | Umbricht | 74/827 |
| 3,580,111 | 5/1971 | Tyrner | 74/817 |
| 3,633,442 | 1/1972 | Stosen | 74/827 |
| 4,050,355 | 9/1977 | Niskanen | 409/221 |
| 4,084,504 | 4/1978 | Fuchs | 101/115 |
| 4,474,109 | 10/1984 | Yara | 101/115 |
| 4,606,268 | 8/1986 | Jaffa | 101/115 |
| 4,669,378 | 6/1987 | Lee | 101/115 |
| 4,890,514 | 1/1990 | Wickham | 74/816 |
| 4,909,142 | 3/1990 | Bubley | 101/115 |

OTHER PUBLICATIONS

Satellite Publications, "The automatic round screen printing machine," Jan. 4, 1990.

*Primary Examiner*—Edgar S. Burr
*Assistant Examiner*—Ren Yan
*Attorney, Agent, or Firm*—Fitch, Even, Tabin & Flannery

[57] ABSTRACT

An automatic screen printing press has a platen turntable carrying a plurality of platens which are indexed through a plurality of stations in an endless path of movement past printing heads having a power-driven squeegee carriage thereon. The turntable is driven by a powered carriage having a linear guide that causes the carriage to have a linear reciprocal movement. Each of the printing stations has a roller cam that is selectively engaged by a shifting fork that is mounted for movement with the carriage. The shifting fork is driven in a transverse reciprocal direction to the linear reciprocal movement of the carriage for selective engagement with and disengagement from a roller cam.

4 Claims, 10 Drawing Sheets

ROTATABLE, MULTI-COLOR SCREEN PRINTING APPARATUS

This is a division of application Ser. No. 07/592,037, filed Oct. 3, 1990, now U.S. Pat. No. 5,154,119.

This invention relates to a screen printing apparatus, and especially to an apparatus of that general kind which is designed for multiple-impression screen printing on a relatively high production basis.

For volume production of multiple copies it is necessary that the object being printed be moved quickly from station to station in a multiple station printing apparatus, and necessary, if not critical, that the registration of the object to be printed with a particular printing screen in a progression of printing screens be maintained with reasonable accuracy. For this purpose it has heretofore been proposed that the objects to be printed, or multiple such objects, be emplaced upon platens which are carried by a turntable in a circular path beneath a circular array of progressive printing heads each located one indexing step distant from the next, with one or more stations left vacant for the unloading of the printed object from the platen and its replacement with yet another object to be printed.

It has, however, been found that certain screen printing operations do not always lend themselves to a neatly ordered time sequence, due largely to the difference in drying times of those varieties of inks used for screen printing, or to a particular printing sequence which may require certain colors or large ink applications such as the printing of a solid field as a preliminary to the superposition thereon of subsequent art work. In such cases, either a longer drying time is required, or a "flash" drying step may be required before the further application of different colors is attempted.

Currently, purchasers of multi-color screen printing apparatus purchase equipment with a larger number of printing heads than the actual number of different colors they intend to print. This is because the different artwork and the different substrates being printed require the ability to print at each sequential location and to be able to use a flash cure unit at each of these sequential locations. Additionally, the heat imparted to the ink and substrate at a flashing may interfere with the next immediate printing because only a very short period of time has elapsed, e.g., 6–10 seconds for the ink and substrate to cool. To allow for more cooling, the station following the flashing station is left open and the printing head thereat is disabled. Thus, the cured ink has an entire printing and indexing step to cool as the pallet shifts into the open station and pauses before indexing to the next station at which the next printing operation will occur. In large color applications such as printing with eight colors, two or more flashes of ink with a subsequent cooling may be used. In order to print three or four colors, printers will often buy a six color or six head machine in order to have the flexibility to print, flash and cool at the six different stations.

The flashing or curing apparatus is usually a portable unit that is mounted on wheels that allows it to be shifted into a position overlying a platen with the printing head having been raised to allow the flashing head to be positioned closely adjacent and superimposed over the substrate and the platen. As described more fully in co-pending application entitled "Frame Mountable Curing Apparatus and Method", filed of even date, and assigned to the assignee of this application, the turning on of the flash unit, the turning off of the flash unit, or the overriding of the flash unit is controlled by the controller of the screen printing apparatus. This patent application is hereby incorporated by reference as if fully reproduced herein.

A further problem with current rotatable screen printing apparatus is that equipment is built for a particular, fixed number of print heads, usually six, eight or up to sixteen heads. Some printers would like to have a multi-color printer that could be expanded to print a larger number of colors by an easy addition of print heads at a later time.

SUMMARY OF THE INVENTION

The present invention provides greater flexibility in printing, flashing and/or cooling sequence by having a movable print head that can be quickly and easily shifted from one printing station to another printing station leaving an open printing station into which may be positioned a flash curing unit or which may be left open to allow a cooling before being shifted to a subsequent printing head. Preferably, the movable print head is rotatably mounted on a central column for swinging between at least two adjacent printing stations.

Additional printing heads may be purchased later and mounted on the frame and set into an open printing station to increase the number of colors capable of being printed by the machine.

The apparatus further includes an indexer that is driven by a fluid power drive including a reciprocal carriage which engages and swings members on the pallet indexer to swing it through an arcuate movement between each sequential printing position.

The apparatus includes a lift of the printing head carriage for the squeegee and the flood bars to provide greater visibility in setting up the screen, inking of the screen, access for screen cleaning, and to allow insertion of a flash cure unit above the platen, Preferably, the print head is biased to its open position by gas springs.

The apparatus uses replaceable bushings for mounting the printing heads and/or mounting the indexer turret on the central column. The replaceable bushings comprise a plurality of parts that can be disassembled and removed and allow insertion of a similar new bushing without having to the machine apart as has been necessary heretofore.

The apparatus further comprises a narrow, elongated support for a pallet which allows sleeve boards or leg boards to be substituted for a T-shirt pallet quickly without tools. A leveling system for the elongated support is placed radially inwardly of the pallet so as to be out of the way thereby allowing unobstructed loading and unloading of garments onto the pallet without hinderance.

The apparatus includes an indexer which is sized to project outwardly a predetermined radial distance related to a width for shipping. The platen supports are detachably mounted after transport to project radially outwardly of the predetermined distance. Adjustable leveling devices on the turret readily level the detachable platen supports. The frame support for the printing heads also projects outwardly for a predetermined distance related to the shipping width. The printing heads are attached after shipment to project beyond the shipping width.

While developed specifically for application to a self-contained, turntable-indexing type of screening apparatus, the concept is of course applicable in specifically different and non-circular arrays. The requirement, as heretofore stated, is that gaps be left in the arrays into which adjacent printers may be moved to vary the ink drying period between successive imprints in a regularly indexing, production screen printing facility.

BRIEF DESCRIPTION OF THE DRAWINGS

The invention is explained in reference to a preferred embodiment illustrated in the accompanying drawings, in which.

DETAILED DESCRIPTION OF THE PREFERRED EMBODIMENT

Figure 1:
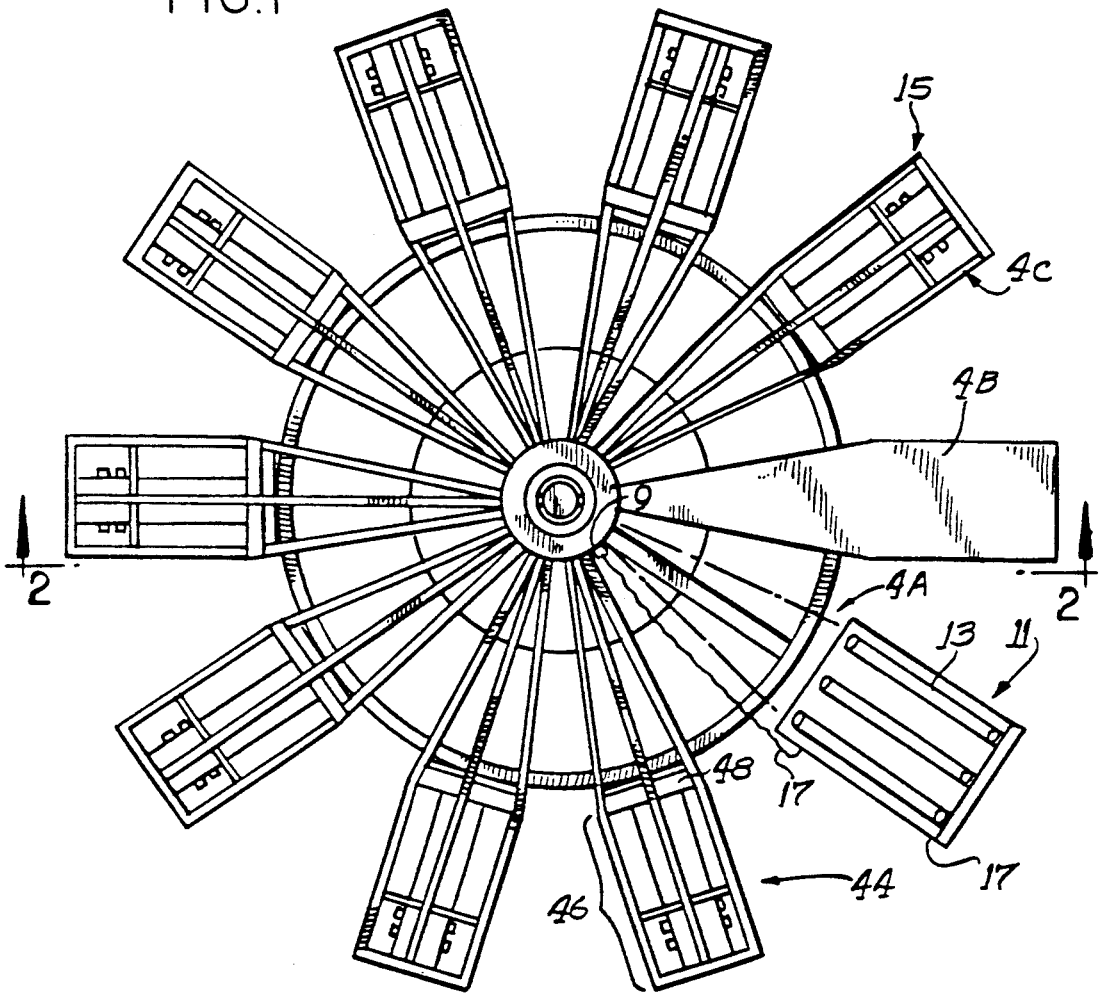
FIG. 1 is a diagrammatic plan view of a turntable served multiple screen printing apparatus in accordance with the invention.
Figure 2:
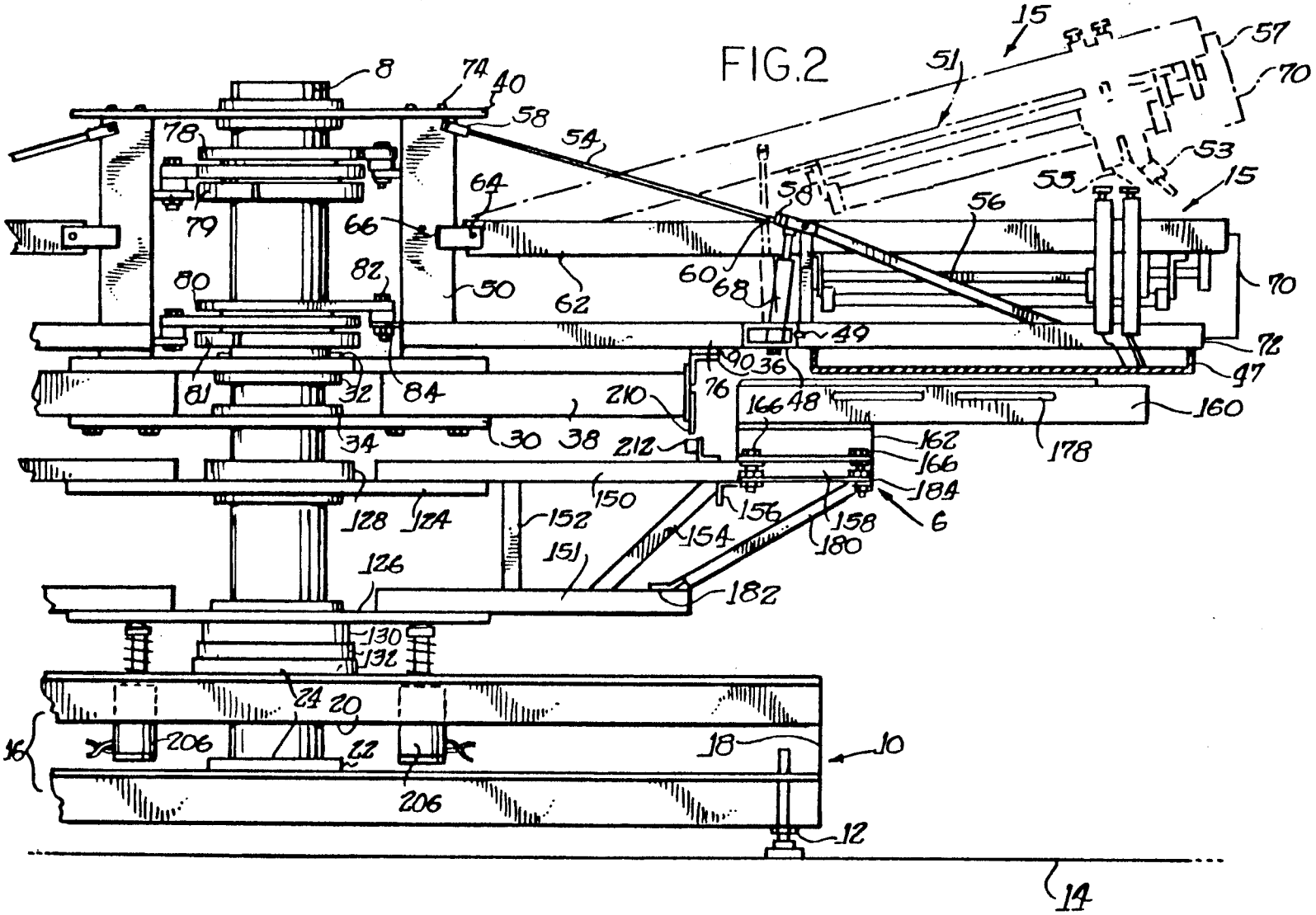
FIG. 2 is a fragmentary elevational view of the apparatus shown schematically in FIG. 1.

Referring initially to FIGS. 1 and 2 of the drawings for detailed description of the invention, the disclosed screen printing apparatus comprises a series of circularly arrayed stations 4 (FIG. 1), ten in the illustrated case, some of which are printing stations, others of which are loading and unloading stations, and others of which are gaps deliberately left in the array of screen printers which may be used simply as time extenders for the drying of ink applied at the preceding printing station, or which may, when necessary, be used as a drying station by the insertion of movably mounted drying equipment into the station purposely left vacant.

The printing stations 4 and the platen turntable 6 which serves them are mounted upon a central column 8 which is secured in a base frame provided with adjustable feet 12 to level the same upon the printing shop floor 14. The frame comprises a pair of spaced, generally horizontal plates 16 stiffened by peripheral and internal framing and secured in spaced relation by a plurality of struts of which only one is shown in FIG. 2 to prevent obscuring more important aspects of the mechanism. The column passes through a central opening in the upper plate of the base frame 20, is seated upon the lower plate 22, and is secured to both by metal collars 24 which surround the column and are welded both to the column and to the upper and lower frame plates, respectively, which support them.

The upper portion of the column carries the circular array of screen printing heads 15, all carried at the ends of arm-like trusses 26 which radiate outwardly from the central column and are secured in circumferentially-spaced relation by their attachments to upper support plates 40 and lower 36 support plates secured to the column. The upper support plate 28 is fixed between collars 32 secured to the column near its upper end. The lower support plate 30 is one of two such plates incorporated into a spider frame which is likewise fixedly mounted on the central column by stop collars 34 similar to those which position the upper plate. Spokes 38 of the spider frame secured between the two central plates thereof extend radially outwardly to an angle iron ring 36, one flange of which engages and supports the under sides of the arm trusses 26 which carry the printing mechanisms, which extend outwardly in cantilever fashion beyond the support ring to serve the printing platens 42 carried by the turntable still to be described.

Figure 3:
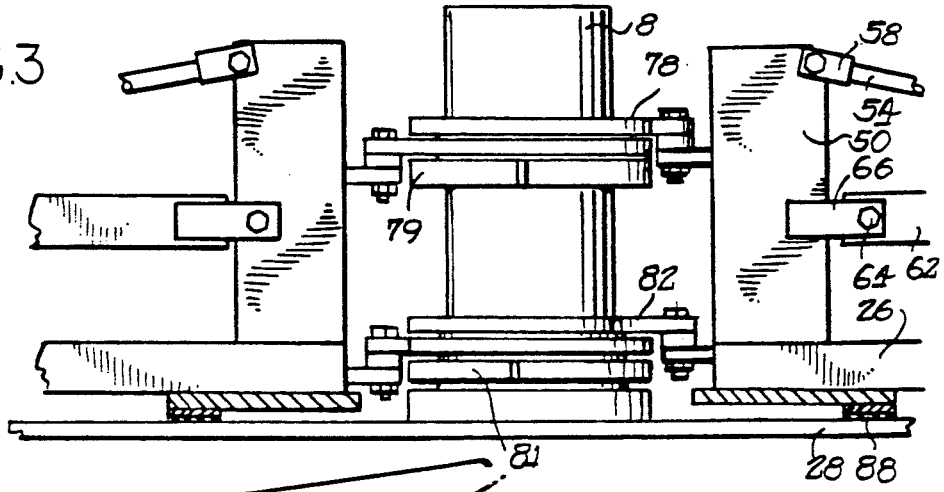
FIG. 3 is an enlarged fragmentary elevational view of a portion of FIG. 2.
Figure 4:
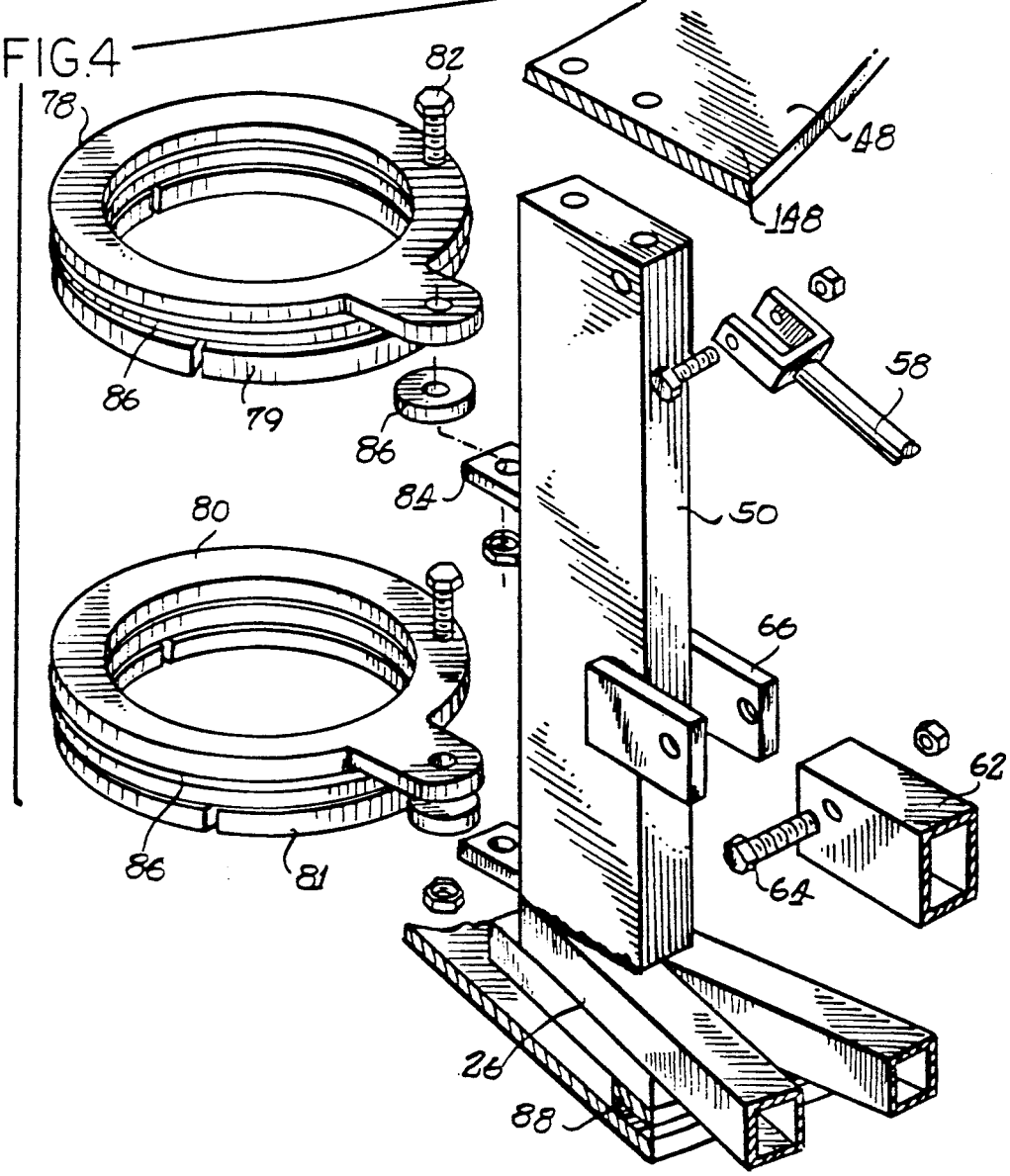
FIG. 4 is an exploded assembly view of a portion of the apparatus shown in FIG. 2, illustrating in particular the movable mounting for lateral adjustment of the support arms of certain of the printing stations viewed in plan in FIG. 1.

The structure and mounting of the arm truss 26 of both the fixed and the movable arms is shown in FIGS. 2, 3, and 4, insofar as their elevational aspects are concerned, and by FIG. 1 in plan. From the latter it will be seen that each arm truss consists of a horizontal A-frame 44 having at its outer end a rectangular perimeter frame 46 which carries the supports for the frame of a removable printing screen (not shown in FIG. 2). The A-frame and perimeter support framing 46, which carries a screen holder 47 and a printing screen 45, are preferably fabricated in two parts to reduce the overall radial dimension of the apparatus for shipment, both the A-frame and the perimeter frame being formed essentially of square tubing, with an open-ended rectangular tube 48 at the base or connection end of the rectangular frame securable to the A-frame by bolting 49.

The printing heads 15 may be disconnected by the bolting 49 and by loosening a pivot pin connection 64 of an upper lift beam 62 reducing the overall width of the equipment to eight feet or less, which is the predetermined maximum width for shipping. The printing head tubing frame, when bolted to the support tube 48 with the lift beam 62 bolted, positions the print at the desired location. As will be explained below, the pallet and its support are also detachable for shipping to limit the maximum width of the apparatus to that commonly desired for shipping via truck.

At the inner end of the arm truss is a tubular post member of rectangular cross-section 50 incorporated into the A-frame by welding, and secured by bolts to the spaced upper and lower support plates on the column. Upstanding from the rectangular perimeter frame for supporting a screen frame 46 are smaller posts 52, one at each rear corner of the perimeter frame, and each secured by an adjustable tie rod 54 to the larger inner post, and braced in the upright position by a diagonal strut 56 approximately aligned with the tie rod. The tie rod is secured to the two posts respectively by a clevis 58 at each end pinned to the two posts, and the adjustment or take-up of the tie rod is provided by a double-threaded turn bolt 60 at the outer end of the tie rod.

The movable printing carriage mechanism 51, including the squeegee 108 and flood bar 106 and a pneumatic cylinder to drive the squeegee and flood bar carriage 98, is carried on a lift beam 62 which is anchored at its inner end by a hinge bolt 64 based between support lugs 66 secured to the inner post, and supported approximately at mid-length by a pair of gas springs 68 pivotably mounted in the broader cross tube 48 of the perimeter frame with their respective piston rods pivoted at their outer ends to the beam. The lift beam and printing mechanism carried on its underside are normally latched in the solid line position of FIG. 2 by a hook 70 extending down from the end of the lift beam engaged with a detent or latch 72 on the perimeter frame, but upon release of the detent 72 rises under the force of the counterbalancing gas springs 68 to the broken line position of FIG. 2.

With the printing carriage mechanisms 51 and lift beam 62 raised to the upper dotted line position shown in FIG. 2, the operator will have easy access to the screen to add more ink, to adjust the screen, to clean the screen, or to position a flash curing unit over the platen after having removed the screen 45 from the screen holder 47. The gas springs bias and hold this portion of the printing head up in its open position once the latch 70 is released.

As earlier indicated, the movable arm trusses 26 of the turntable-served array of printing heads 15 are likewise secured to the upper and lower support plates of the column by means of bolts 74 and 76 which are readily removed to permit the swinging movement of the movable arm truss 26. In addition, however, the movably supported arm trusses are secured to the central column 8 by means of a pair of upper and lower retaining rings 78 and 80, which are bolted 82 to lugs 84 extending radially inwardly from the inner posts 50 of the movable trusses. Intervening spacing washers 86 alter the fixed levels of attachment lugs to adapt them for connection respectively to the stacked retaining rings 78 and 80 which surround the central column B, two such sets of upper and lower rings being shown in the illustrated case, preferably separated from each other by a nylon washer. Segmented bearings 79 and 81 are located below the top and bottom retaining rings which primarily hold the retaining rings 78 and 80 in position without welding them to the central column 8. These segmented bearings are described in detail later.

At their inner ends, the A-frame of the truss arms 26 engage the lower support plate with a nylon pad 88 to reduce the frictional resistance to the swinging of the movable truss between positions, and a similar nylon pad 90 secured to the underside of the A-frame where it is supported by the support ring 36 of the spider is provided for the same purpose.

Thus, when it is desired to move one of the movable printing stations between any of its available positions, it is simply necessary to remove the positioning bolts 74 and 76 which secure the inner post 50 to the upper support plate 40, swing the arm truss to its new location, and reinsert the bolts to hold the movable frame in its new position. The positioning bolts and the holes in the upper support plate are precisely located at one indexing position so that the head 15 will precisely position at a printing station in alignment with a platen when the indexer is stopped.

FIG. 1 illustrates a flash curing unit 11 having a plurality of quartz bulbs 13 mounted in a stand 17 and located at what would be a printing station 4A. A cable 7 extends from the curing unit to a plug 9 on the screen printing apparatus to connect to the controller for operating the electric drive motor for indexing and the cylinders for the printing operations. The next station 4B may be left open for the substrate and ink to cool after being flashed in the station 4B. The print head 4C could be swung into the open print station 4B or into the print station 4A if no print head is located there. In larger size printing apparatus, two or three swingable print heads are usually provided.

Figure 7:
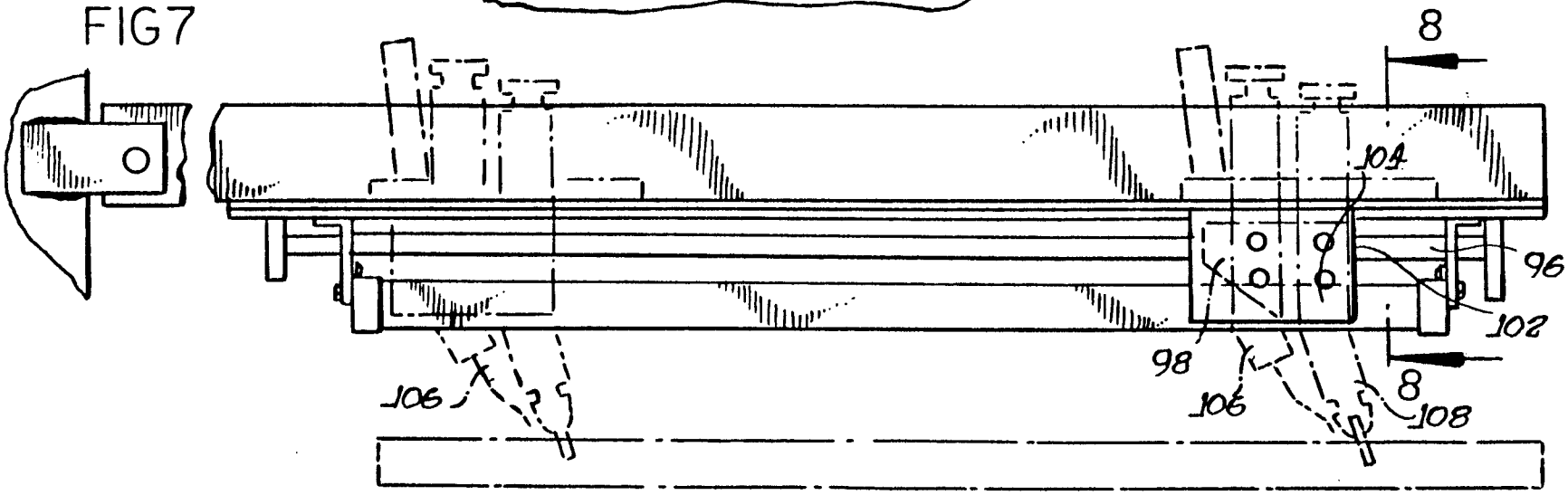
FIG. 7 is an enlarged fragmentary elevational view of the travelling ink spreading and squeegee apparatus of the screen printer of FIG. 2.
Figure 8:
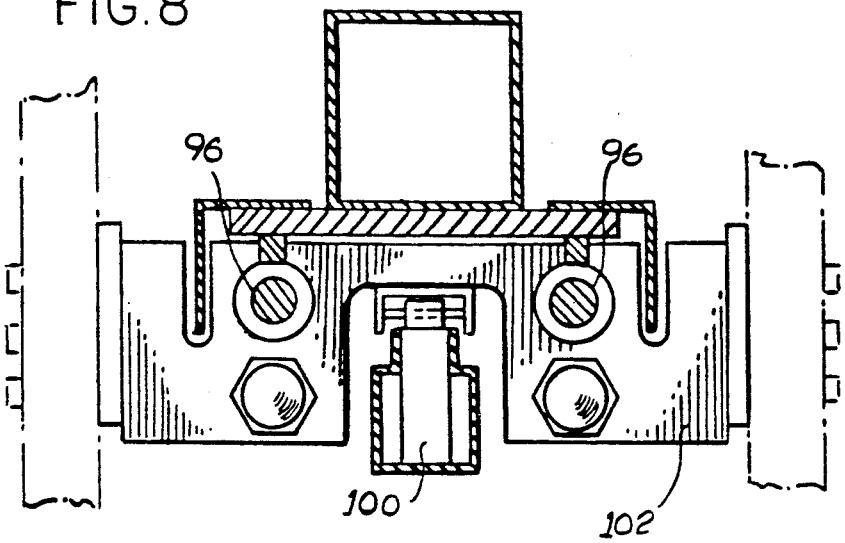
FIG. 8 is a sectional view taken along the line 8—8 of FIG. 7 providing further detail of the movable parts of the printing head.

The printing head 15 proper, underslung from the lift beam 62 at its outer end, is shown in some detail in FIGS. 7 and 8. Essentially, it comprises a reciprocable carriage 98 mounted by means of Thompson linear bearings upon a pair of round shafts 96 supported by brackets from a plate secured to the underside of the lift beam. The carriage 98 is driven along its two mounting shafts 96 by means of a rodless air cylinder 100, the movable carriage 102 of which is secured to the underside of the print head carriage. Mounted on each side of the carriage is a plate 104 which supports the two active members of the printing head, namely, the ink flood bar 106 and the printing squeegee 108, on a power driven parallel linkage which alternately raises and lowers the ink flood bar 106 while lowering or raising the printing squeegee 108. The driving force for the selective positioning of the two active members is a double-acting air cylinder which also serves to maintain one or the other in its lowered active position, the ink flood bar 106 being lowered for the movement of the carriage outwardly and the printing squeegee 108 being lowered for the opposite printing motion of the carriage inwardly. For this action, it is satisfactory to slave the wiper/flood bar linkage to the air cylinder which drives the carriage, inasmuch as they operate in synchronism.

Figure 18:
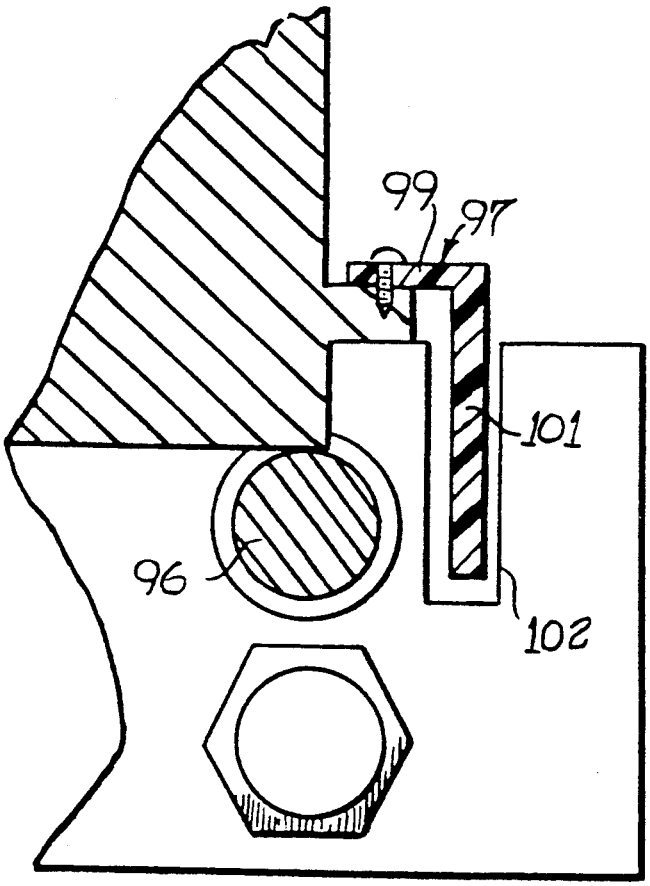
FIG. 18 is a view showing Thompson linear bearings and the rods covered by a splash guard.

The Thompson linear bearings 97 and the rods 96 are preferably covered by a splash guard 97 which is made of plastic and which is fastened to a block at a horizontal flange 99 with a depending vertical flange 101 mounted in a slot 102. The bearing illustrated in FIG. 18 is a three quarter round bearing and, in a sense, is open to contamination by ink or other foreign material but for the splash guard 97. The splash guard also protects the round shafts 96 from being splashed with ink or otherwise contaminated.

The support of the screen frame from the outer, perimeter frame of the arm truss is illustrated in part in FIG. 7.

Platen Turntable

Referring back to FIG. 2, the turntable comprises a pair of upper and lower central plates 124 and 126, each of which is provided with a central opening to receive the column 8 to which the turntable is journalled by a pair of segmented bearings 128 and 130 inserted into the central opening of the upper plate from above and into the central opening of the lower plate from below.

Beneath the bearing of the lower plate is a thrust bearing 132 which rests upon the column-securing collar 24 atop the base frame 16.

Figure 5:
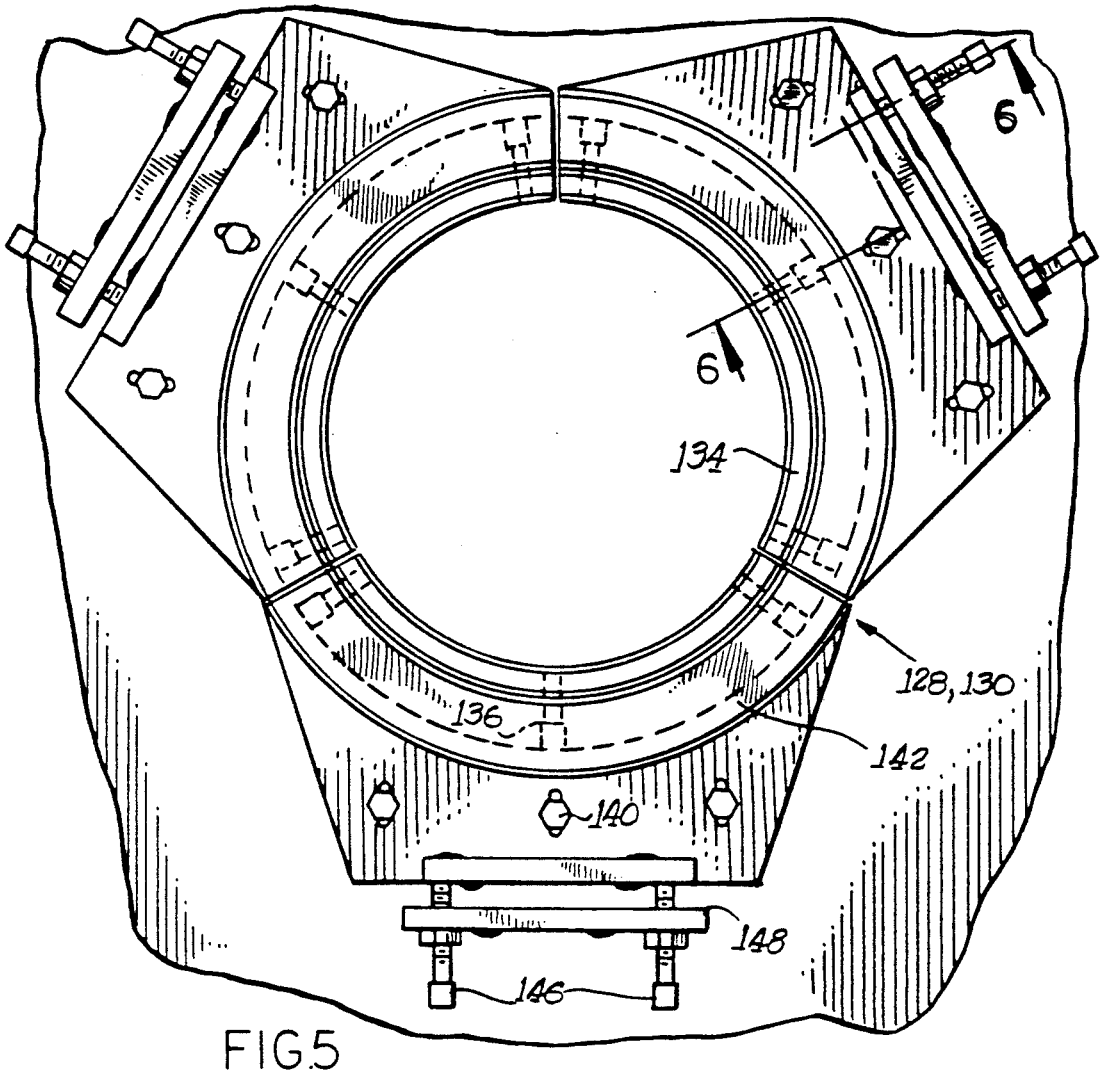
FIG. 5 is an enlarged plan view of the bearings of the rotary turntable shown generally in FIG. 2.
Figure 6:
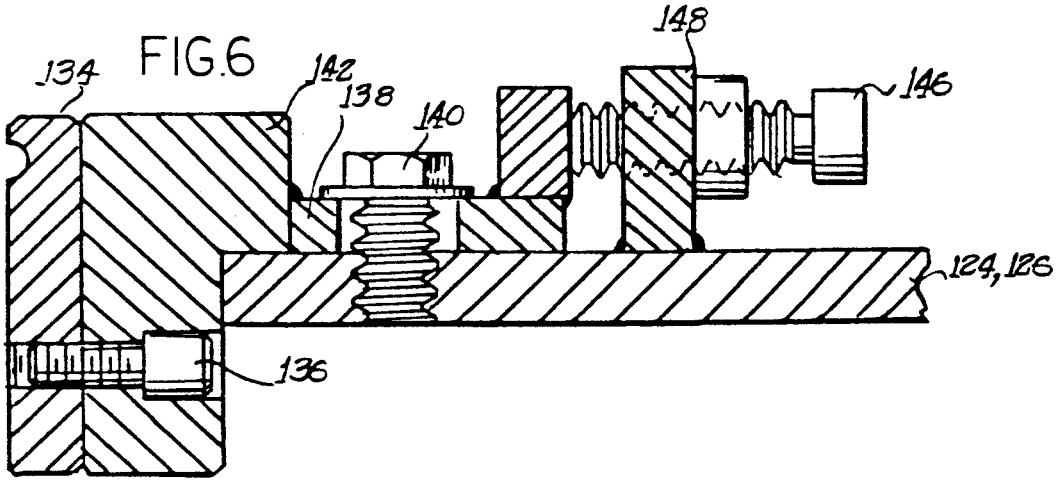
FIG. 6 is a sectional view of the line 6—6 of FIG. 5 illustrating in detail the adjustable nature of the turntable bearings.

The segmented bearings 128 and 130 of the turntable, along with the segmented bearings of the retaining rings 79 and 81, are shown in detail in FIGS. 5 and 6, from which it will be seen that each of the bearings is divided into three equal segments or shells, each having an internal shoe of bronze 134 or like bearing material secured to the bearing hub by suitable cap screws 136 positioned respectively below and above the upper and lower central plates when the bearing hub is positioned within the central openings thereof. A flange 138 on the segmented bearing hub 142 limits its entry into the opening of its associated central plate, to which it is secured by three cap screws 140 which pass through slots in a web extension of the hub flange, resting in face-to-face relation with the associated central plate 124 or 126. To adjust the running clearance between each bearing and the journal of the central column 8, each hub segment is positioned for radial adjustment within the central opening of its associated plate, and each is engaged by a pair of jack screws 146 mounted in tapped holes in a bracket 148 upstanding from the central plate adjacent to the hub extension. The latter is provided with an upstanding shoulder against which the adjusting jack screws abut, and which receive the adjusting force of the jack screws to drive the hub segment radially inwardly when the hub clamping screws are loosened.

The segmented bearings 128 and 130 provide not only for take-up of wear experienced by the bushing over time, but also for the ready replacement of the bushing turntable without the necessity of removing the turntable from the central column. The apparatus employs segmented bearings which allow replacement of the bearings without having to dismantle the machine. This allows repair and replacement at a low cost to the user.

As best seen in FIG. 2, the body of the turntable consists of a number of vertically aligned upper and lower spoke members 150 and 151 of rectangular tubing which are welded at their inner ends to their respective central plates 124 and 126 and joined in truss-like fashion by a vertical strut 152 near the peripheries of the central plates and by a diagonal strut 154 extending upwardly and outwardly from each lower spoke to an upper spoke where the upper spoke is joined to an underlying angle iron ring 156 which encircles the turntable. The number of such truss-like spokes in the turntable is equal to the number of stations in the apparatus, ten in the illustrated case (FIG. 1), with each spoke of the turntable carrying at its outer end a platen 42 which transports the workpiece from station to station.

Figure 11:
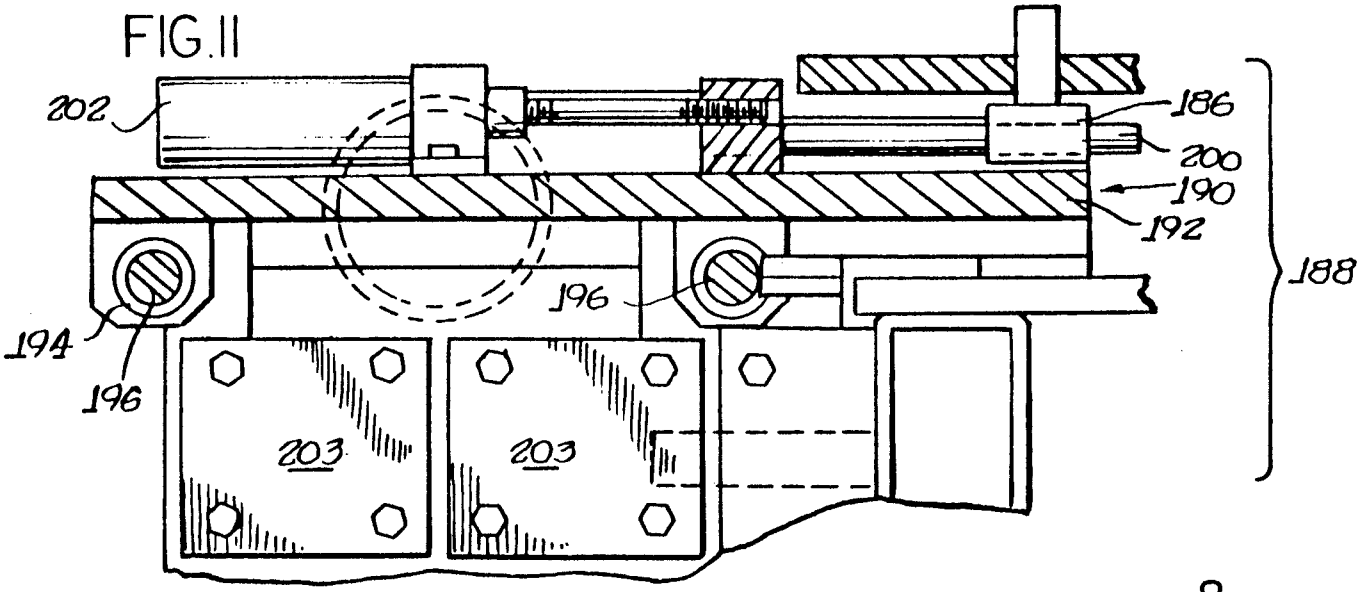
FIG. 11 is a sectional view taken on the line 11—11 of FIG. 10.
Figure 15:
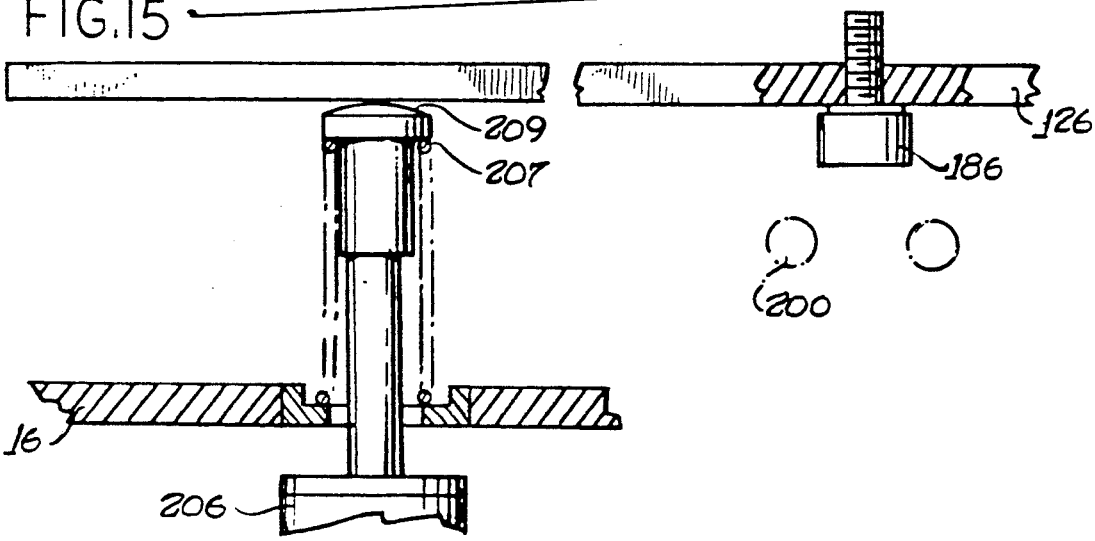
Figure 16:
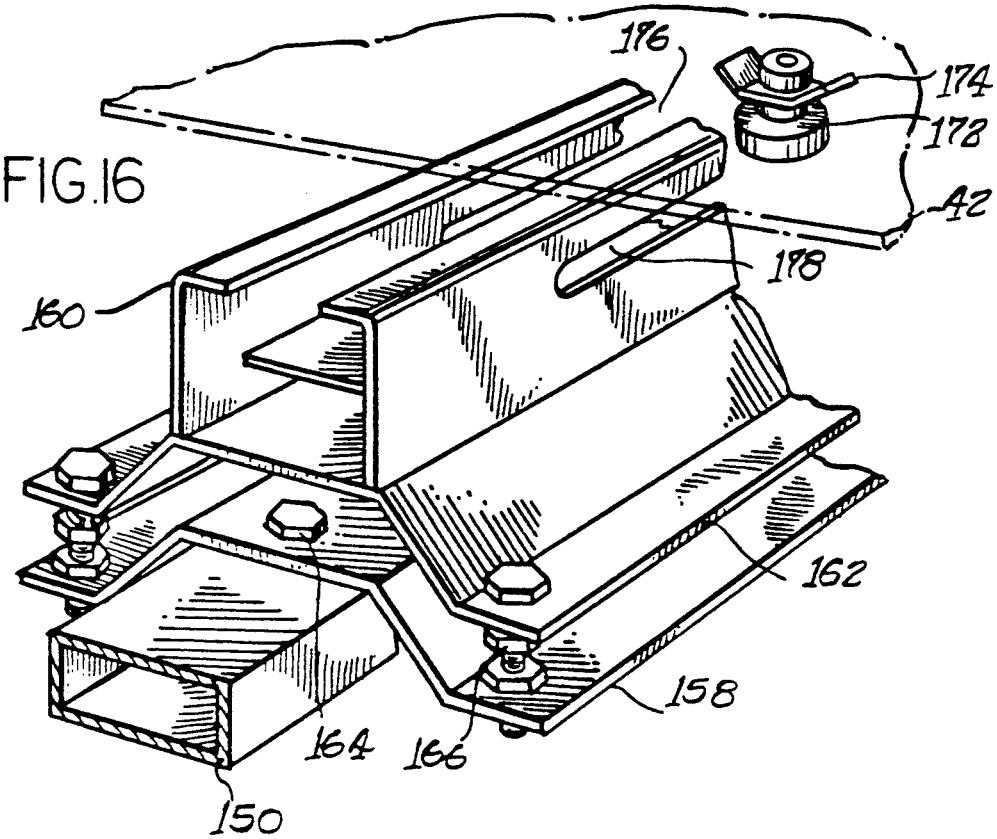
FIG. 16 is a perspective view of the adjustable platen support for levelling the platen with the common plane with all of the platens carried by the turntable parallel to the generally common plane of the screens in the several printing stations.
Figure 17:
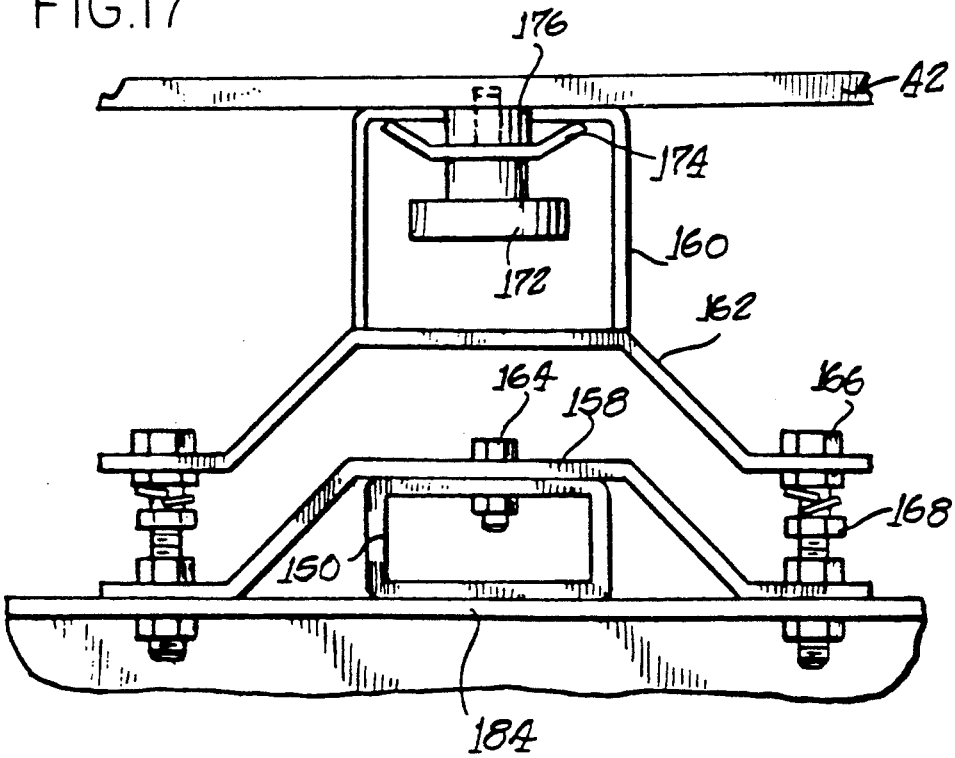
FIG. 17 is a view of the same adjustment mechanism illustrating the removable mounting working supporting platen on its bottom arm of the turntable.

Referring to FIGS. 11, 15, and 16, in addition to FIG. 2 for the details of the support of the printing platen 42, it will be seen that there is provided at the outer extremity of the upper spokes of the turntable truss an inverted V-shaped plate 158 which is bolted 164 to the upper spoke 150. An extension arm 159 in the form of an upwardly open channel 160 has secured thereto at its inner end an identical inverted V-shaped plate 162 which is secured to the plate at the outer end cf the upper spoke by means of four adjusting screws 166 which are individually adjustable and secured in any position of adjustment within their respective ranges by locknuts 168 to provide for the levelling of a platen 42 mounted on the extension arm in both the radial and circumferential directions.

The platen 42 itself and the extension arm 159 which supports it are fashioned for the ready removability of the platen 42 from the extension arm 160 and its replacement by another, as needed for a particular run of objects to be printed. For that purpose, each platen 42 is provided on its underside with a clamping screw 172 which passes through a clamping bracket 174 adapted to straddle the open slot 176 in the top of the extension arm to secure the platen 42 in position. Finger access to two such clamping screw 172 arrangements on the underside of each platen is provided by window slots 178 in the sides of the extension arm 160. Preferably, a bushing is provided on the screw 172 sized to the width of the slot so that the platen is aligned axially with the elongated channel. In shipping the upper plate 162 and elongated channel are unbolted to reduce the width of the machine to less than the predetermined shipping width. At the assembly site, the channels are reattached and the leveling operation is then done.

In addition to the support of the lower V-shaped plate 158 by the outer end of the upper spoke 150 of the turntable, there is further provided a flared sheet metal strut 180 (FIG. 2) formed with downwardly turned stiffening flanges, and is bolted at its narrow end 182 to the lower spoke member 151 of the turntable and at its outer end 184 to the lower of the two inverted V-shaped plates at its outer end, being secured to the latter by the two outermost platen-adjusting screws 166.

Indexing, Elevating, and Registration Mechanism

Figure 9:
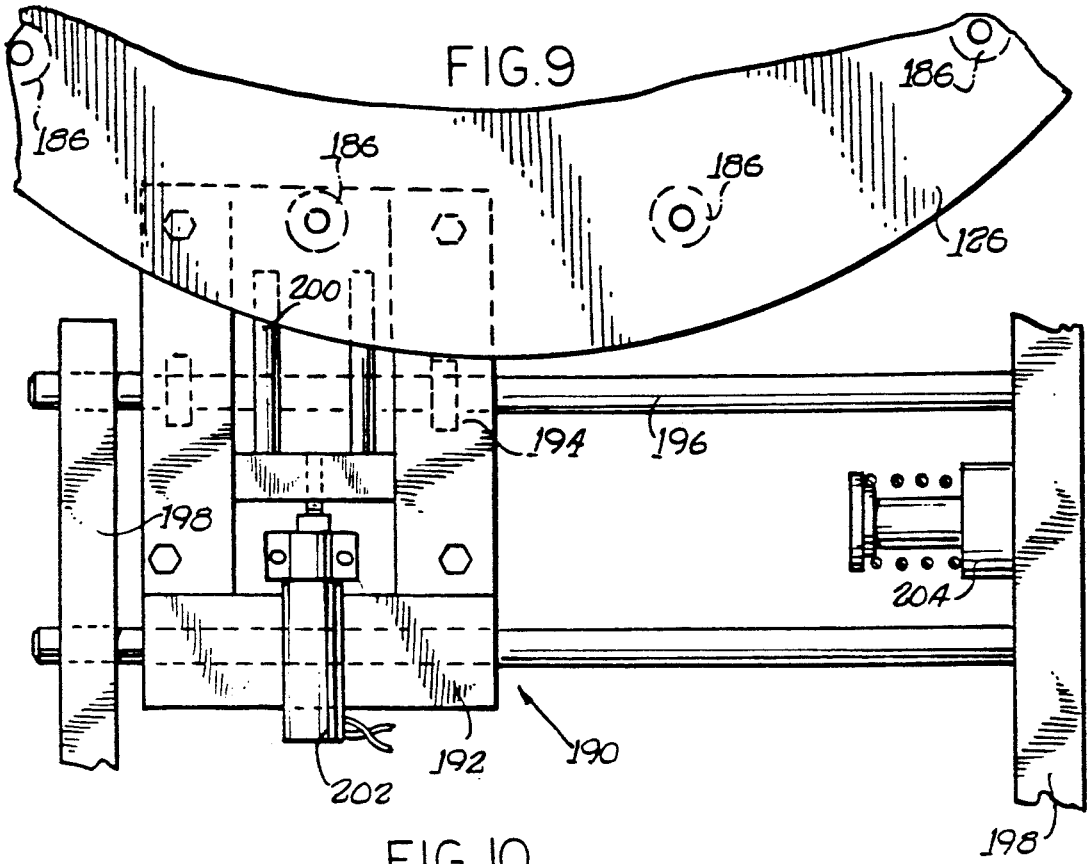
FIGS. 9 and 10 are similar plan views of the linear indexing mechanism shown in the two extreme positions of movement of the drive carriage.
Figure 10:
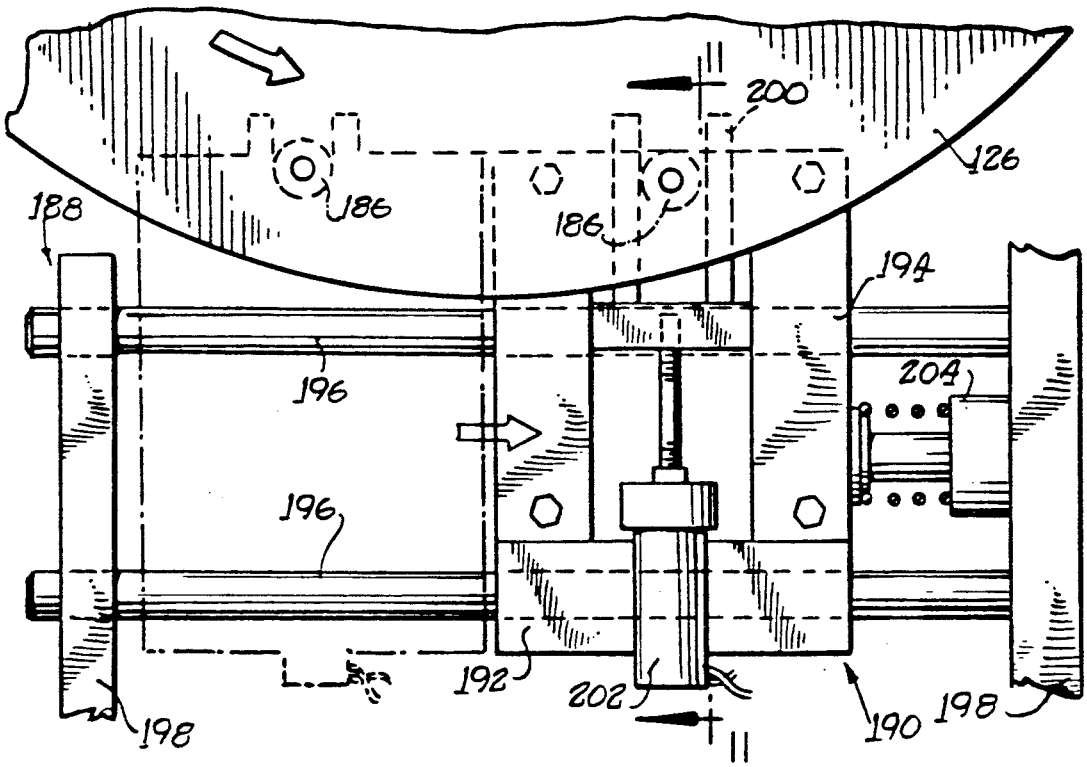

For indexing the turntable from station to station a number of equispaced roller cam followers 186 equal to the number of stations of the apparatus is secured to the underface of the lower central plate 126 of the turntable near its outer periphery, as shown in FIGS. 9 and 10. With the turntable resting on its thrust bearing 132 as shown in FIG. 2, the cam followers 186 are positioned vertically for engagement by the indexing mechanism 188 shown in FIGS. 9, 10, and 11.

The indexing mechanism 188 comprises an air powered carriage 190 mounted on the base frame of the machine for linear reciprocal movement in a direction tangent to the lower central plate 126 of the turntable, beneath which the carriage of the indexing mechanism 188 extends. The carriage 190 itself comprises a plate 192 mounted on two Thompson linear bearings 194 whose shafts 196 are secured at their ends in brackets 198 attached to the base frame 16 of the machine. Mounted upon the plate and confined in ways thereon is a transversely reciprocal shifting fork 200 powered by a double-acting air cylinder 202 between an extended position at which it may entrap one of the cam followers 186 on the underside of the lower central plate 126 and a retracted position clear of the path of movement of the cam followers 186. The indexing carriage 190 itself is driven by a tandem rodless air cylinder 203 (FIG. 11), the movable carriages 190 of which are secured to the underside of the plate 192 which constitutes the principal part of the carriage of the indexing mechanism.

It will be apparent from examination of FIGS. 9 and 10 that the shifting fork 200 is withdrawn from engagement with a cam follower 186 at the end of the indexing stroke to permit the carriage 190 to return to the left as seen in FIG. 10. The air cylinder 202 thrusts forward the fork 200 to engage the next of the cam followers in the progression. In this manner, the next single stroke of the carriage of the indexing mechanism 188 drives the engaged cam follower and the turntable in the feeding direction.

Because of the inertia of the moving turntable while being indexed, the indexing carriage 190 and shifting fork 200 are sturdily built and a spring loaded shock absorber 204 is provided at the end of the indexing carriage stroke to assist in bringing the turntable movement to a smooth stop at its newly indexed position without jarring.

Figure 14:
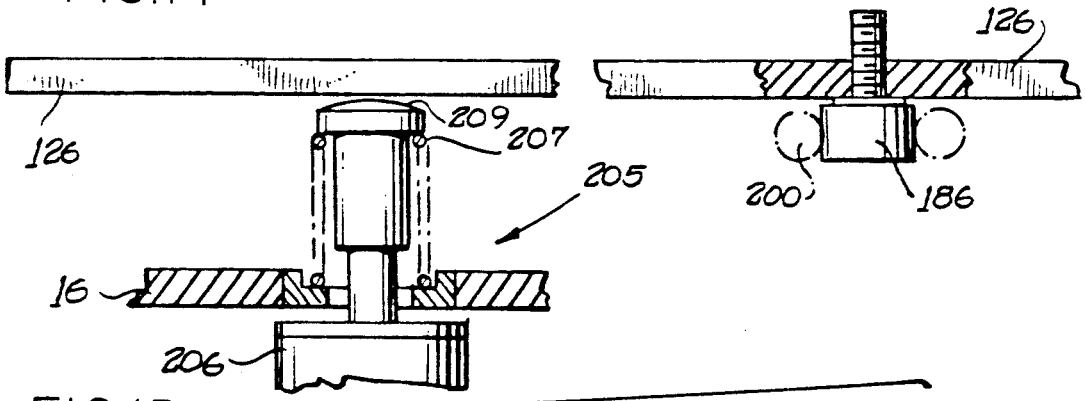
FIGS. 14 and 15 are schematic illustrations of the operation of the turntable mechanism in related to the indexing and registry mechanisms.

When the turntable is in its lowered position, i.e., the position illustrated in FIG. 2, and assuming that the shifting fork 200 of the indexing mechanism 188 is withdrawn, the carriage 190 is unrestrained and may be rotated if desired by manually applied force. In normal operation, however, movement of the turntable is occasioned entirely by the indexing mechanism 188, from which, in the normal function of the machine at the end of each indexing stroke, the turntable is disengaged by an elevating mechanism 205 in the form of two air cylinders 206 (FIGS. 14 and 15) having cylinder rods biased by springs 207 with upper slide pads 27 which engage the underside of the lower central plate 126 to lift the turntable out of the grasp of the indexing mechanism 188 and into the control of the registration mechanism 208 now to be described. At the lifted position, the platen is beneath the screen ready for the printing operation.

Figure 12:
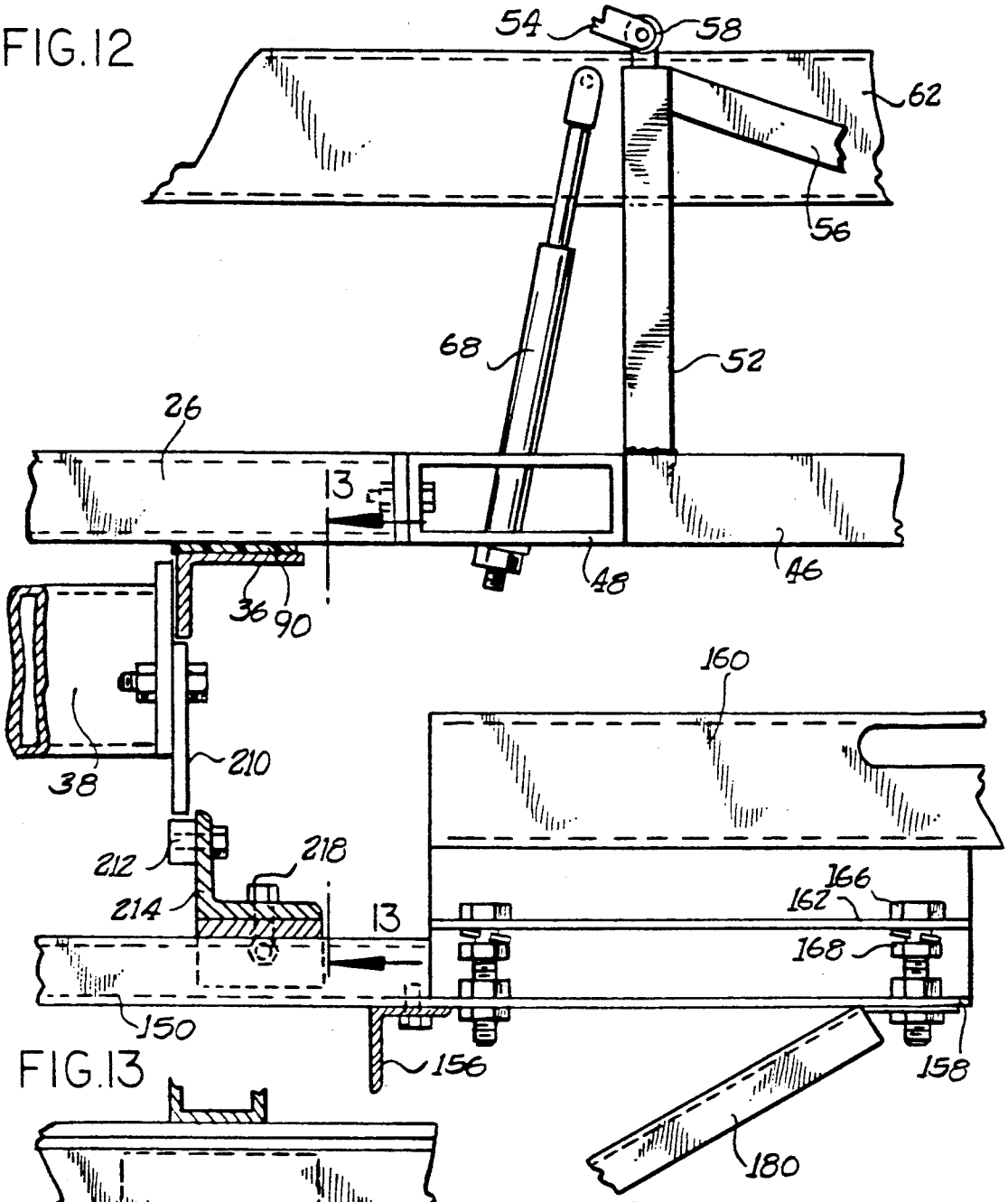
FIG. 12 is an enlarged fragmentary elevation of the mechanism of FIG. 2 selected for better illustration of the registry mechanism.
Figure 13:
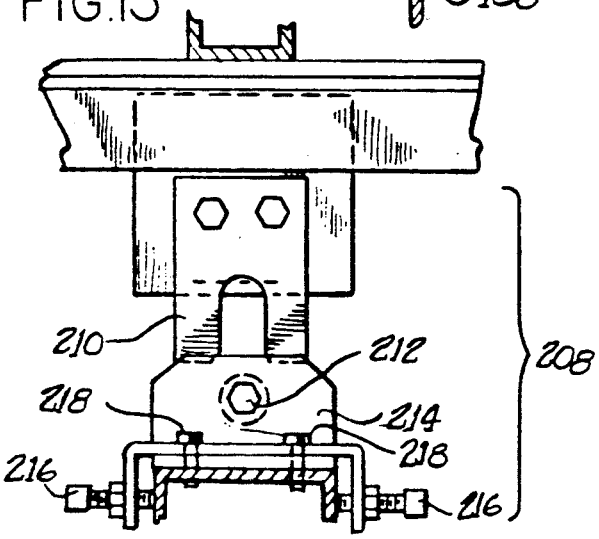
FIG. 13 is a sectional view along the line 13—13 of FIG. 12.

The registration mechanism 208 is shown in detail in FIGS. 12 and 13, and is oriented with respect to the overall apparatus by FIG. 2.

It comprises a number of stationary registration forks 210 secured about the periphery of the lower support frame of the printing station trusses 38 at the outer ends of the spokes thereof beneath the supporting ring 36 for the arm trusses 38 which carry the printing stations. These stationary downwardly-open locating forks 210 are disposed for engagement with a plurality of roller cam followers 212 on the turntable when it is raised by the elevating mechanism 205, thus locking the turntable in printing position with its numerous platens appropriately positioned at their respective stations.

As shown in FIGS. 12 and 13, each cam follower 212 is mounted on a bracket 214 which is in turn screwed to the upper spoke 150 of the turntable near its outer end just inwardly from the platen adjusting plates. As shown particularly in FIG. 13, the bracket 214 is formed of angle iron, the base or seating flange of which is extended and bent downwardly at right angles, where it provides a tapped seat for a pair of adjusting screws 216 by means of which the cam follower 212 may be adjusted sidewardly, i.e., in the peripheral direction of the turntable, before being clamped securely to the turntable spoke by means of the two clamping screws 218 provided, each of which passes through a slotted hole in the base flange cam follower mounting bracket 214 into a tapped hole passing through a reinforcing pad welded to the upper wall of the tubular spoke and through the wall of the spoke itself.

The cam follower 212 fits within the registration fork 210 with a running clearance of 4 to 5 thousandths of an inch, which would be multiplied to some extent in sideward movement of the platen itself at the greater radius of the platen. For that reason, and because the respective positions of the registration forks 210 and the cam followers 212 of the turntable cannot be machined with perfect accuracy, both the mounting brackets 214 for the cam followers 212 on the turntable and the registration forks 210 on the underlying support structure for the printing stations are made sidewardly adjustable, so that, in setting up the machine for operation, it is possible to remove the effective clearance or backlash by so adjusting the cam followers 212 and forks 210 as to cause successive fork-engaged cam followers to be engaged on opposite sides thereof when the turntable is elevated for registration.

In the overall operation of the apparatus, it is the interaction of the cam followers 212 on the turntable and the registration forks 210 on the overlying support frame which produces the operating registration of the several screens with the workpieces on the platens as they move from printing station to printing station. It will be understood, of course, that the fine registration of the screen frames at the respective printing stations will have been performed in the setup of the machine by use of the screen frame adjusting mechanisms earlier described. Once, however, the registration of successive screens with each other has been performed, the indexing movement of the platens seriatim from station to station and in proper registry with successive screens, is performed by the engagement of the registration forks 210 by the cam followers 212 of the turntable as the latter is elevated at the conclusion of each indexing stroke.

What is claimed is:

1. An indexing apparatus, for a screen printing apparatus having a platen turntable and a plurality of print stations, the platen turntable having a plurality of platens, which index from station to station with a predetermined frequency comprising:

a roller cam follower means for every station of said screen printing apparatus;

a powered carriage means for linear reciprocal movement to index the platens of the platen turntable from station to station and having linear guide means for guiding the carriage means for such linear reciprocal movement; and a transversely reciprocal powered shifting fork attached to said powered carriage means for engaging successively each of said roller cam follower means for indexing and being powered independently of the carriage means for movement relative to the powered carriage means.

2. An indexing apparatus, for a screen printing apparatus having a platen turntable and a plurality of print stations, the platen turntable having a plurality of platens which index from station to station with a predetermined frequency comprising:

a roller cam follower means for every station of said screen printing apparatus;

a powered carriage means for linear reciprocal movement to index the platens of the platen turntable from station to station, the powered carriage means comprising at least two shafts attachable to the screen printing apparatus, at least two linear bearings attached to the shafts, an attachment means attaching said powered carriage means to said linear bearings;

a transversely reciprocal powered shifting fork attached to said powered carriage means engaging said roller cam follower for indexing;

a cylinder means attached to said powered shifting fork for reciprocal shifting of the fork; and a cylinder means attached to said powered carriage means for reciprocating the powered carriage.

3. An apparatus in accordance with claim 2 where said cylinder means attached to said powered shifting fork is a double-acting air cylinder.

4. An apparatus in accordance with claim 2 where said cylinder means attached to said powered carriage means is a tandem rodless air cylinder.

* * * * *